US007669981B2

(12) United States Patent
Ozaki et al.

(10) Patent No.: US 7,669,981 B2
(45) Date of Patent: Mar. 2, 2010

(54) INK JET PRINT HEAD SUBSTRATE, INK JET PRINT HEAD, INK JET PRINTING APPARATUS, AND METHOD OF MANUFACTURING INK JET PRINT HEAD SUBSTRATE

(75) Inventors: Teruo Ozaki, Yokohama (JP); Ichiro Saito, Yokohama (JP); Sakai Yokoyama, Kawasaki (JP); Kenji Ono, Setagaya-Ku (JP); Satoshi Ibe, Yokohama (JP); Kazuaki Shibata, Kawasaki (JP); Toshiyasu Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/407,012

(22) Filed: Mar. 19, 2009

(65) Prior Publication Data

US 2009/0179938 A1 Jul. 16, 2009

Related U.S. Application Data

(62) Division of application No. 11/407,980, filed on Apr. 21, 2006, now Pat. No. 7,533,969.

(30) Foreign Application Priority Data

Apr. 28, 2005 (JP) ..... 2005-132315
Mar. 17, 2006 (JP) ..... 2006-075236

(51) Int. Cl.
*B41J 2/05* (2006.01)

(52) U.S. Cl. ..... 347/61

(58) Field of Classification Search ..... 347/19, 347/61–63
See application file for complete search history.

(56) References Cited

U.S. PATENT DOCUMENTS

| | | | | |
|---|---|---|---|---|
| 5,363,134 | A | 11/1994 | Barbehenn et al. | |
| 5,504,507 | A | 4/1996 | Watrobski et al. | |
| 5,660,739 | A | 8/1997 | Ozaki et al. | |
| 5,886,364 | A * | 3/1999 | Zhang | 257/53 |
| 5,956,052 | A | 9/1999 | Udagawa et al. | |
| 6,231,155 | B1 | 5/2001 | Udagawa et al. | |
| 6,315,396 | B1 | 11/2001 | Ozaki et al. | |
| 6,390,589 | B1 | 5/2002 | Imanaka et al. | |
| 6,485,131 | B1 | 11/2002 | Saito et al. | |
| 6,530,650 | B2 | 3/2003 | Ozaki et al. | |
| 6,663,228 | B2 | 12/2003 | Saito et al. | |
| 6,974,208 | B2 | 12/2005 | Park et al. | |
| 2004/0085405 | A1 | 5/2004 | Baek | |
| 2006/0061626 | A1 | 3/2006 | Saito et al. | |

FOREIGN PATENT DOCUMENTS

JP 3-126560 A 5/1991

* cited by examiner

*Primary Examiner*—An H Do
(74) *Attorney, Agent, or Firm*—Fitzpatrick, Cella, Harper & Scinto

(57) ABSTRACT

An ink jet print head substrate capable of precisely blowing fuse element to store data reliably is provided. An ink jet print head incorporating such a substrate and an ink jet printing apparatus are also provided. The interlayer insulating film formed over the fuse element is made of a material that has a lower melting point than the material of the fuse element and which forms a cavity therein by heat produced when the fuse elements is blown.

11 Claims, 19 Drawing Sheets

INK JET PRINT HEAD SUBSTRATE, INK JET PRINT HEAD, INK JET PRINTING APPARATUS, AND METHOD OF MANUFACTURING INK JET PRINT HEAD SUBSTRATE

CROSS REFERENCE TO RELATED APPLICATION

This application is a divisional application of U.S. patent application Ser. No. 11/407,980, filed Apr. 21, 2006, and issued as U.S. Pat. No. 7,533,969 on May 19, 2009, the entire disclosure of which is incorporated herein by reference.

BACKGROUND OF THE INVENTION

1. Field of the Invention

The present invention relates to a multilayered substrate for an ink jet print head, an ink jet print head using it, an ink jet printing apparatus and a method of manufacturing the ink jet print head substrate.

2. Description of the Related Art

An ink jet print head, for example, is constructed of a combination of a head substrate and a nozzle member. The head substrate comprises a base substrate and an ink ejection structure formed of various layers on a surface of the base substrate. The ink ejection structure has heater elements (electrothermal transducers) in an electrothermal conversion system and piezoelectric elements in an electromechanical conversion system. Generally, on the surface of such a head substrate a driver circuit for driving the ink ejection structure and a data input unit for supplying print data to the driver circuit are also formed of various layers.

At present, another construction is being proposed in which a ROM (Read Only Memory) is mounted on the head substrate of the ink jet print head to hold various kinds of data that can be read as required. The data held in the ROM may, for example, include an ID (identity) code of the ink jet print head and data on drive characteristics of the ink ejection structure. Japanese Patent Application Laid-open No. 3-126560 (1991), for example, describes an ink jet print head having an EEPROM (Electrically Erasable Programmable ROM) mounted thereon.

In the ink jet print head disclosed in Japanese Patent Application Laid-open No. 3-126560 (1991), however, since the EEPROM is mounted separately from the head substrate, the print head construction becomes complicated, making reductions in size and weight of the print head and the printing apparatus as a whole difficult. Particularly when there is a large volume of print data, the existing large-capacity ROM chip is useful. But when the volume of print data is small, the use of the large-capacity ROM chip is disadvantageous in terms of cost.

U.S. Pat. Nos. 5,504,507 and 5,363,134 disclose a construction in which a ROM consisting of a fuse array is formed in the base substrate of the head substrate of the ink jet print head along with layers such as an ink ejection structure. This construction allows the fuse array, that constitutes the ROM, to be formed at the same time that the layers of ink ejection structure are formed in the base substrate during the process of fabricating the head substrate. The fuses in the array are selectively blown so that desired binary data are held in the fuse array according to the states of the fuses. An ink jet print head using such a head substrate does not need to have a ROM chip prepared separate from the head substrate. Thus the structure for holding various data in a manner that allows them to be read out can be simplified, realizing an improved productivity of the print head and its reduced size and weight.

One method of blowing the fuse element involves, for example, evaporating a fuse portion with a laser beam to open its electrical path. This fuse blowing method, however, is not suited for mass production of the print head because it causes a fused material to adhere to the substrate and because of a prohibitive cost of the blowing process. Another method blows the fuse portion by passing a large electric current through it. Because of a smaller amount of fused material adhering to the substrate and a lower cost, this method is suited for the print head mass production. The method of blowing a fuse by applying a large current, however, has a drawback that since a wattage used to blow the fuse (large capacity rated heat loss) is limited by a resistance of the fuse element, the thermal energy generated is small. Thus, to blow the fuse portion reliably to open the electrical path requires special considerations in the construction of the fuse portion.

Further, since in the ink jet print head ink is present over the substrate, there is a risk that, should an excessively large crack be produced by the blowing of the fuse portion, the ink may get through the crack to reach the substrate. Any ink, once it has infiltrated to the blown fuse portion and electrodes formed on the substrate, can corrode them, impairing the reliability of the ink jet print head.

SUMMARY OF THE INVENTION

An object of this invention is to provide a substrate for an ink jet print head capable of accurately blowing fuse elements to store data highly reliably, and also to provide an ink jet print head, an ink jet printing apparatus and a method of fabricating the ink jet print head substrate.

In the first aspect of the present invention, there is provided an ink jet print head substrate comprising:

an ejection energy generation means to generate an ink ejection energy;

a fuse element capable of being blown by passing an electric current therethrough; and a first and second layer overlying and underlying the fuse elements;

wherein at least one of the first and second layer is formed of a first low-melting point material having a lower melting point than that of the fuse elements, the first low-melting point material forming a cavity therein by heat produced when the fuse element is blown.

In the second aspect of the present invention, there is provided an ink jet print head including the ink jet print head substrate of the first aspect of the present invention, the print head being capable of ejecting ink by an operation of the ejection energy generation means and of storing data by the fuse element being blown.

In the third aspect of the present invention, there is provided an ink jet printing apparatus for forming an image on a print medium by using an ink jet print head capable of ejecting ink, the printing apparatus comprising:

a mounting portion capable of mounting the ink jet print head of the second aspect of the present invention;

a means for controlling the ejection energy generation means in the ink jet print head; and a means for reading data stored in the fuse element in the ink jet print head.

In the fourth aspect of the present invention, there is provided a method of manufacturing an ink jet print head substrate, wherein the ink jet print head substrate comprises:

a heating resistor to generate a thermal energy for ejecting ink;

a fuse element capable of being blown by passing an electric current therethrough; and a first and second layer overlying and underlying the fuse elements;

wherein at least one of the first and second layer is formed of a first low-melting point material having a lower melting point than that of the fuse element, the first low-melting point material forming a cavity therein by heat produced when the fuse element is blown;

wherein a cavitation resistance film is formed over the heating resistor;

wherein, when the cavitation resistance film is formed, the fuse element is formed of the same material as the cavitation resistance film.

The ink jet print head substrate of this invention comprises, for example, a polysilicon layer from which a fuse element is formed;

a plasma CVD-SiO layer containing phosphorus that is formed over the polysilicon layer and which, just before the underlying polysilicon layer melts, gasifies to form a large cavity in the substrate when the polysilicon fuse element is blown;

a CVD-SiO layer not containing phosphorus which is formed over the plasma CVD-SiO layer and which controls the size of the cavity and forms an opening through which to release the melted polysilicon to the outside without causing a fracture due to internal crack; and an organic resin layer formed over the CVD-SiO layer to receive and stop the melted polysilicon.

The ink jet print head substrate of this invention eliminates a possibility of ink infiltrating into the crack, assuring a high reliability of data stored in the fuse element. Further, the print head substrate can control the size of the cavity formed when the fuse element is blown, without causing a fracture due to crack.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described by referring to the accompanying drawings.

First Embodiment

Figure 8:
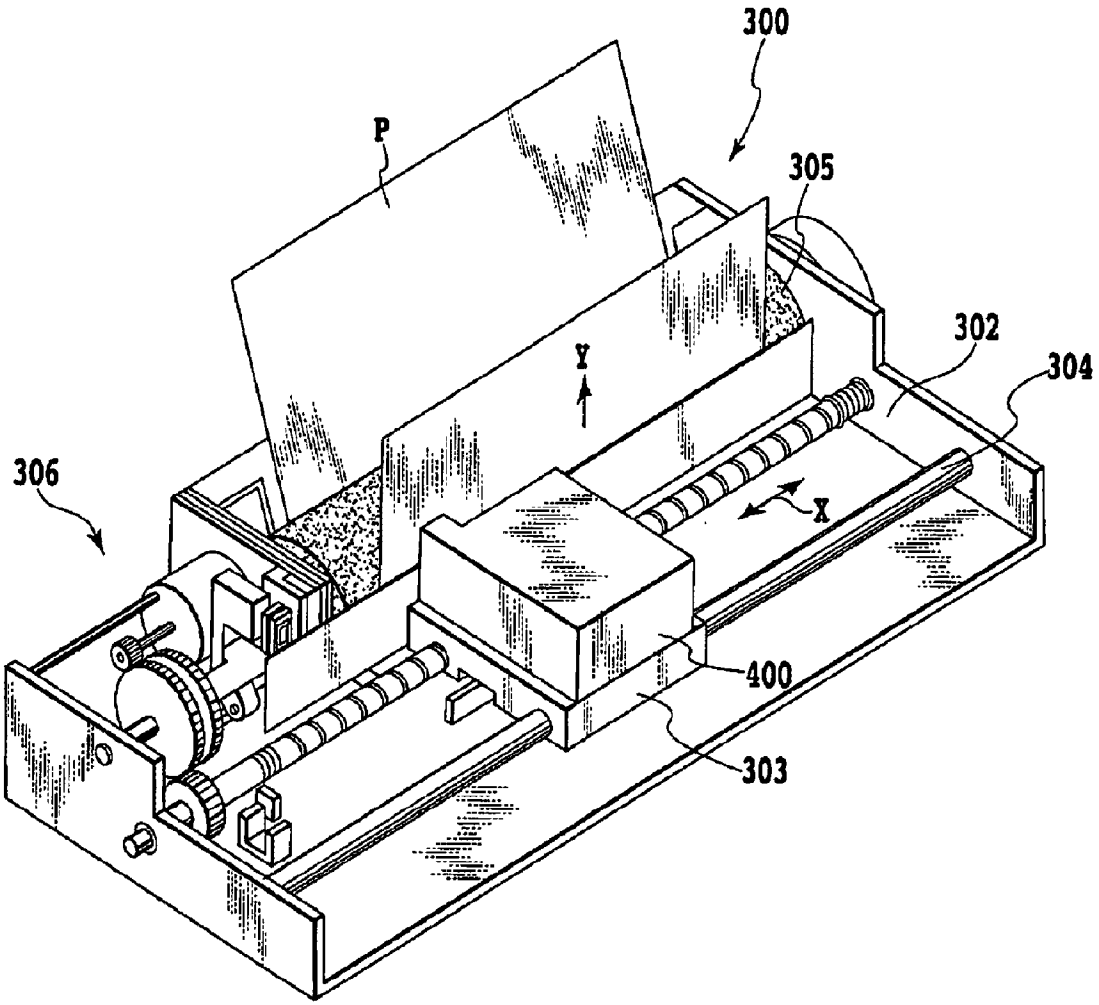
FIG. 8 is an outline perspective view of an ink jet printing apparatus in the first embodiment of this invention.

FIG. 8 is an explanatory view of an example construction of an ink jet printing apparatus that can apply the present invention. The ink jet printing apparatus 300 of this example is of a serial scan type and has an ink jet print head 400, described later, removably mounted on a carriage 303 of a head moving mechanism 302. The carriage 303 is supported on a guide shaft 304 so as to be movable in a main scan direction indicated by arrow X, and is reciprocated along with the ink jet print head 400. At a position facing the print head 400 is installed a platen roller 305 that holds and feeds a sheet of paper P as a print medium. This platen roller 305 forms a paper transport mechanism 306 that successively feeds sheets of paper P in a subscan direction indicated by arrow Y.

Figure 9:
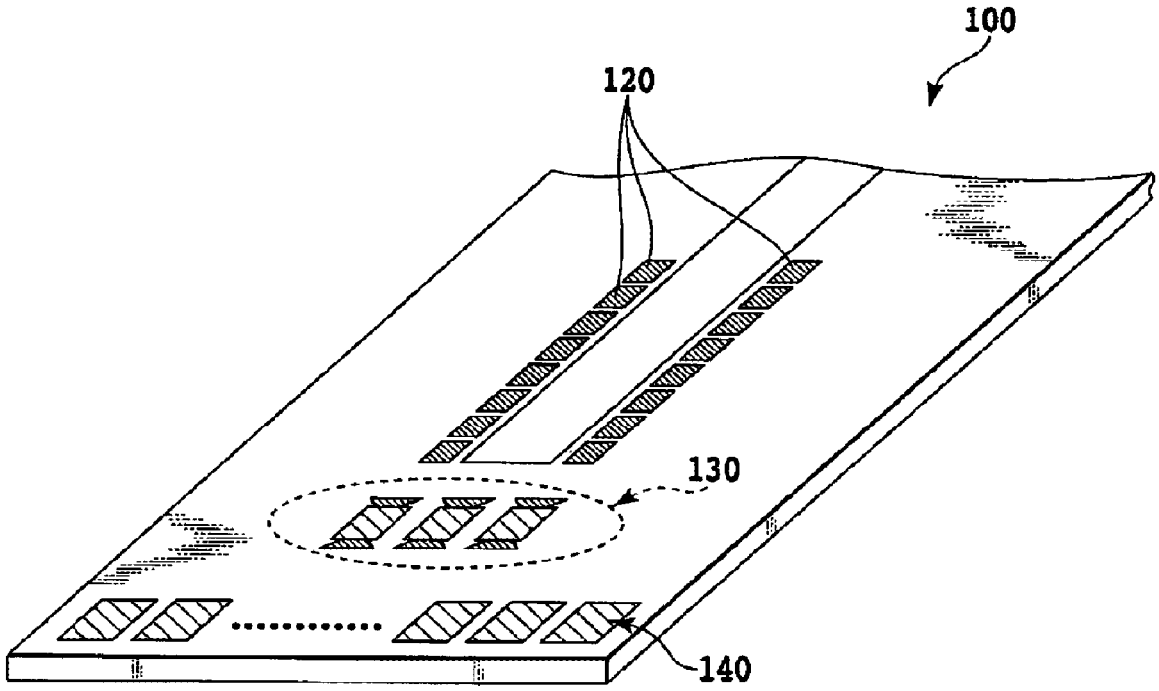
FIG. 9 is a perspective view of a substrate in the ink jet printing head of FIG. 8.

The ink jet print head 400 of this example has built into it a print head substrate 100, such as shown in FIG. 9. The substrate 100 is formed with heater elements 120, a fuse array 130, electrode pads 140 and wires. The heater element 120 generates a thermal energy as an ink ejection energy to heat ink and form a bubble in the ink that expels an ink droplet from an opening of a nozzle not shown. The electrode pads 140 form electrodes for electrically connecting the wires formed on the substrate 100 to external terminals. The fuse array 130 is made up, as described later, of a plurality of fuse elements that can be blown by electric current. Selectively blowing desired fuse elements can store a variety of data.

The fuse array 130 can be made to store an ID code of the ink jet print head 400 and a resistance of the heater elements 120, as data on electrical characteristics required to drive the ink jet print head 400 under an optimal condition. These data are stored in the fuse array 130 at time of shipping of the ink jet print head 400. When the ink jet print head 400 is mounted on the ink jet printing apparatus 300 for use, the printing apparatus 300 reads the stored data from the fuse array 130 in order to operate the print head 400 under the optimal condition.

Figure 10:
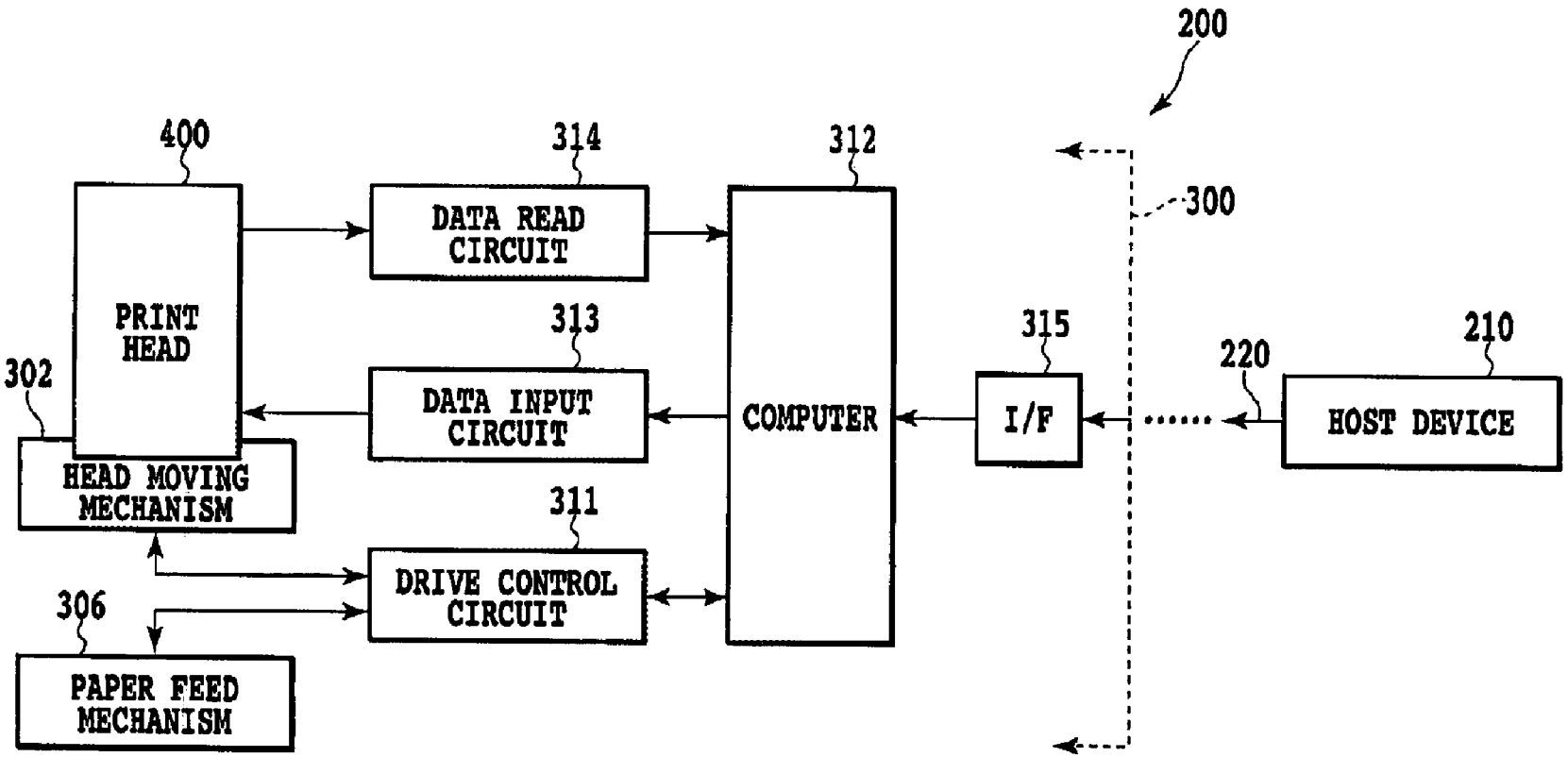
FIG. 10 is a block diagram of a control system in the ink jet printing apparatus of FIG. 8.

FIG. 10 shows a schematic configuration diagram of a control system of the printing apparatus 300. The head moving mechanism 302 and the paper transport mechanism 306 are connected to a drive control circuit 311, which is connected to microcomputer 312. The microcomputer 312 integrally controls the head moving mechanism 302 and the paper transport mechanism 306, realizing a relative motion means that moves the print head 400 relative to the print paper P. With this printing apparatus 300, an image is formed by repetitively alternating an operation that moves the print head 400 in the main scan direction while at the same time ejecting ink droplets from the print head 400 and an operation that feeds the print paper P a predetermined distance in the subscan direction.

The printing apparatus 300 and a host device (host computer) 210, or a central control device, together form an image processing system 200. The printing apparatus 300 and the host device 210 are connected by a communication cable 220. The microcomputer 312 is connected with a data input circuit 313 as a data input means, a data read circuit 314 as a data reading means, and a communication interface 315. The communication interface 315 is connected to the host device 210 through the communication cable 220.

The data input circuit 313 is connected through a connector on the carriage 303 side to a print logic circuit formed on the substrate 100 of the ink jet print head 400. The data read circuit 314 is connected through a connector on the carriage 303 side to a fuse logic circuit formed on the substrate 100 of the ink jet print head 400. The fuse logic circuit is connected to the fuse array 130. The data input circuit 313 supplies print data to the print logic circuit of the ink jet print head 400. The data read circuit 314 reads stored data of the fuse array 130 from the fuse logic circuit of the ink jet print head 400.

The microcomputer 312 integrally controls these circuits 311, 313, 314. For example, it supplies to the data input circuit 313 the print data that the host device 210 inputs to the communication interface 315. The microcomputer 312 controls the data read circuit 314 to read stored data of the fuse array 130 from the ink jet print head 400 and outputs it from the communication interface 315 to the host device 210.

The ink jet printing apparatus 300 has ink tank (not shown) as an ink supply means. The ink tank is removably mounted on the carriage 303 like the ink jet print head 400 and is connected by tube through a socket member (not shown) to an ink holding unit of the ink jet print head 400. The ink tank is filled with ink, which is supplied to the ink jet print head 400.

In the image processing system 200 of FIG. 10, the host device 210 supplies the print data to the ink jet printing apparatus 300 which, based on the print data, forms an image on the print paper P. At this time, according to the integrated control by the microcomputer 312, the head moving mechanism 302 moves the ink jet print head 400 in the main scan direction and the paper transport mechanism 306 feeds the print paper in the subscan direction. In synchronism with these operations, the ink jet print head 400 inputs the print data from the data input circuit 313. The ink jet print head 400 holds the ink supplied at all times from the ink tank and, based on the print data, selectively energizes the heater elements 120 connected to the print logic circuit. Heating the heater elements 120 generates a bubble in the inks whose expansion pressure ejects an Ink droplet from the associated ink ejection openings. The ejected ink droplets land on the surface of the print paper P, forming a dot matrix image on the paper P.

As described above, the substrate 100 of the ink jet print head 400 is formed with the fuse array 130. Before shipping, the manufactured ink jet print head 400 can store in the fuse array 130 its ID code and data on operation characteristics of the heater elements 120. The ink jet print head 400, shipped after the storing operation of such data, is mounted on the ink jet printing apparatus 300. The ink jet printing apparatus 300 now can read the stored data from the fuse array 130 of the ink jet print head 400 through the data read circuit 314. The ink jet printing apparatus 300 adjusts an electric power for driving the heater elements 120 according to the operation characteristics of the heater elements 120 read out from the fuse array 130 of the ink jet print head 400. The ink jet printing apparatus 300 can also notify the ID code of the ink jet print head 400 to the host device 210.

Next, the construction of the substrate 100 for the ink jet print head of this embodiment will be described.

The fuse elements making up the fuse array 130 may be formed in the substrate that already has semiconductor devices such as drive elements and logic circuits built therein during a semiconductor manufacturing process. The fuse elements may also be formed at the same time that the semiconductor devices are formed, by using the same polysilicon of gates that is used when building semiconductor devices on the substrate. In the following, the process of fabricating the fuse elements in the latter case will be described.

Figure 1:
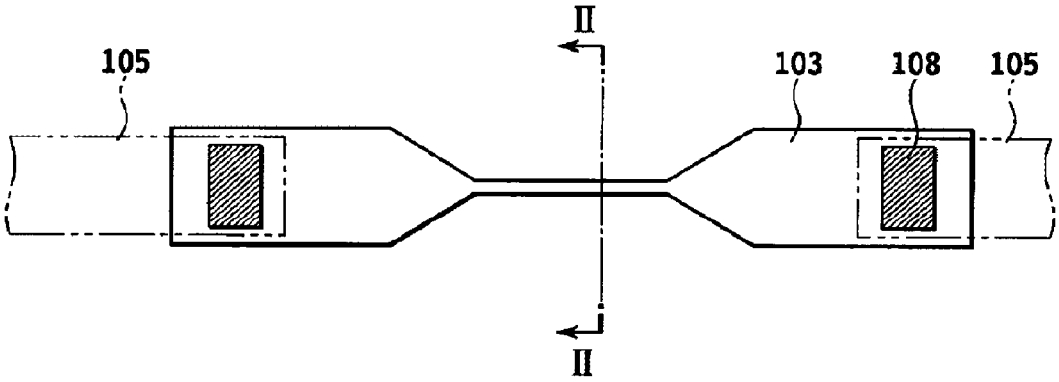
FIG. 1 is a plan view showing a fuse element on a substrate in a first embodiment of this invention.
Figure 2:
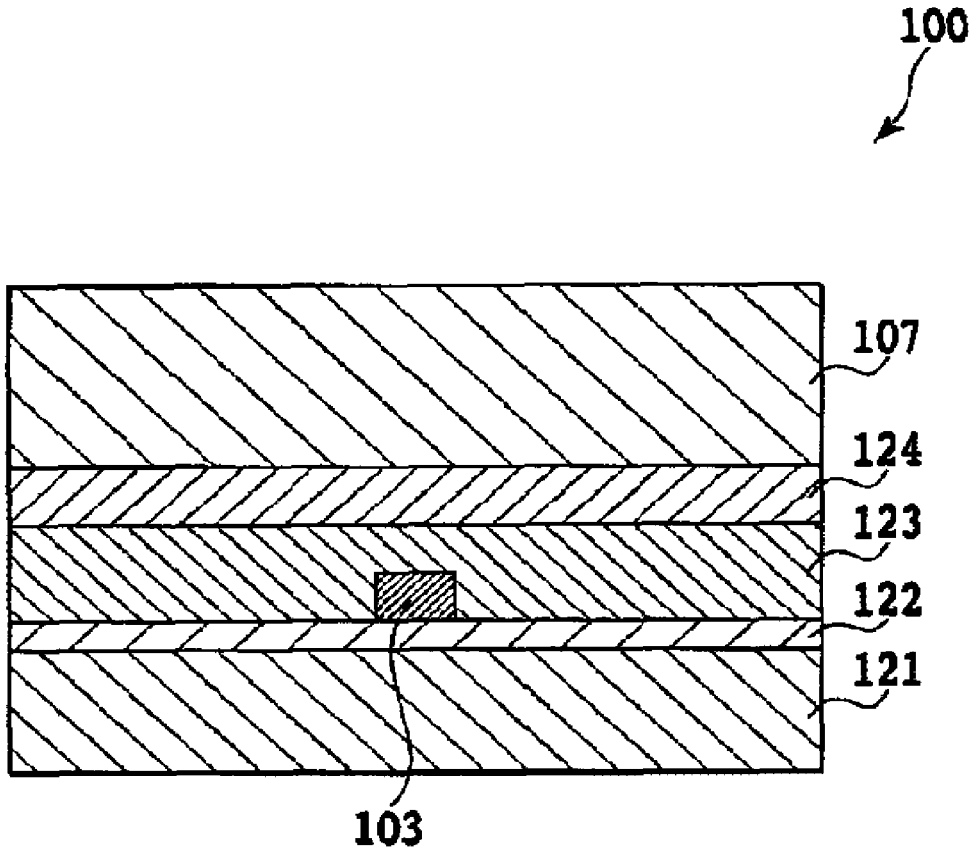
FIG. 2 is a cross-sectional view taken along the line II-II of FIG. 1.
Figure 11:
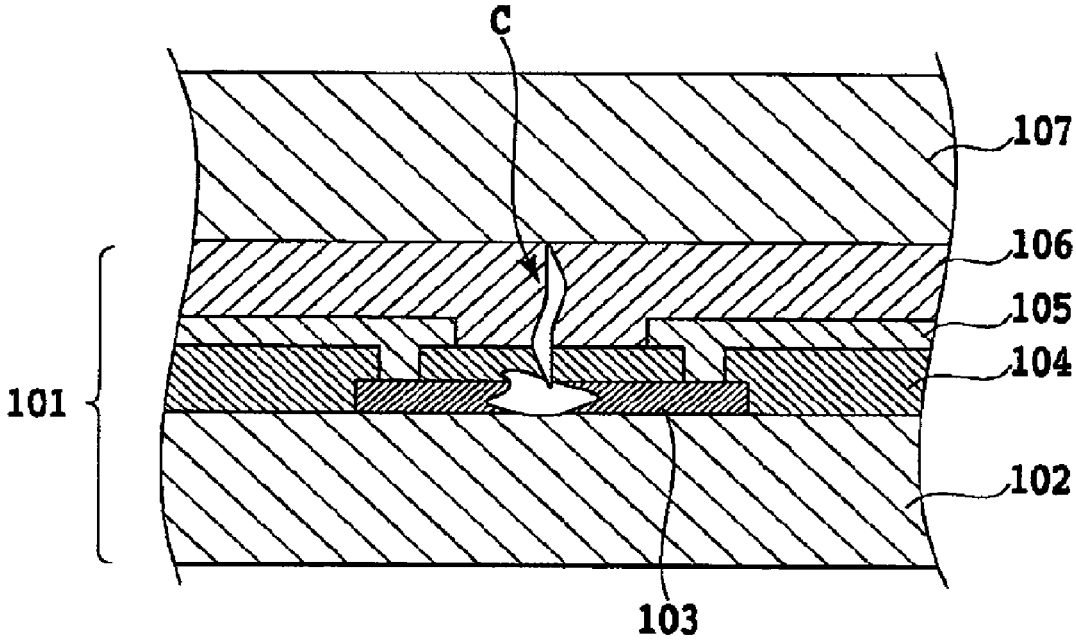
FIG. 11 is a cross-sectional view schematically showing how a crack develops when a fuse element is blown.

FIG. 1 is an enlarged plan view of a fuse element 103 that makes up the fuse array 130 of FIG. 9. Over the fuse element 103 an ink path through which to eject ink is formed of an organic resin layer. FIG. 2 is a cross-sectional view, taken along the line II-II of FIG. 1, of the substrate 100 in which the fuse element 103 is formed. The fuse element 103 of this example is made of polysilicon and formed narrow at its central blow portion (fuse blow portion) 103A for easy fused separation. In an ink jet print head substrate constructed of the same material as the conventional head substrate, which is shown in FIG. 11 for comparison, when a fuse blow portion is blown, a crack C may develop. This crack C is formed in the interlayer insulating film 104 and the protective film (insulating film) 106 when the fuse element 103 is blown, providing a possible path for ink ingress.

The ink jet print head substrate 100 of this example has a thermally grown oxide film 122, fuse elements 103, an interlayer insulating film 123, fuse electrodes 105 and a protective film (insulating film) 124 all appropriately laminated in predetermined shapes over the surface of the base substrate 121. Over the surface of the protective film (insulating film) 124 is formed a nozzle member 107 of organic resin. The ends of the fuse element 103 are connected to the fuse electrodes 105 of aluminum via throughholes 108.

On the thermally grown oxide film 122 formed over the base substrate 121, a polysilicon film is deposited to a thickness of about 4000 Å to form the fuse element 103. Over the fuse element 103 an SiO film containing phosphorus is deposited by the plasma CVD method to a thickness of about 8000 Å to form the interlayer insulating film 123. The interlayer insulating film (SiO film) 123 containing phosphorus is easily gasified to form a hollow space, as described later, by the heat of the fuse element 103 produced when a current to blow the polysilicon fuse element 103 is applied. To prevent a large crack from being formed in a layer overlying the interlayer insulating film (SiO film) 123, the thickness of the interlayer insulating film 123 is preferably set in the range of 0.5-1 μm.

To control the hollow space formed in the interlayer insulating film (SiO film) 123, a plasma CVD-SiO film (protective insulating layer) 124 not containing phosphorus is formed by the plasma CVD method to a thickness of 6000 Å. This film 124 does not easily melt by the heat of the fuse element 103 and thus can minimize the expansion of the cavity in the phosphorus-containing interlayer insulating film (SiO film) 123 and control it to a desired size. The film 124 is slow in melting and only partly melted by heat to form a hole, into which a melted mass from the blown fuse element 103 is allowed to be released, preventing cracks from being caused by an inner pressure that would build up if the expansion of the cavity was completely suppressed. The thickness of the film 124, or SiO film not doped with phosphorus, is preferably set at 0.3-0.8 μm so that it can minimize the expansion of the cavity in the interlayer insulating film (SiO film) 123 doped with phosphorus but still allow a hole to be formed therein.

After the fuse element 103 is formed, TaSiN, a material to form the heater elements 120, is sputtered to a thickness of about 500 Å. This is followed by aluminum (Al) for a wiring layer being formed to a thickness of about 5000 Å. Then, these layers are patterned by photolithography and Al and TaSiN are simultaneously dry-etched to desired shapes using a $BCl_3$ gas. Further, the heater elements 120 are patterned to a desired configuration by photolithography and then wet-etched using mainly phosphoric acid into a desired shape.

Then, these layers are deposited with a SiN film as a protective film to a thickness of about 3000 Å by the plasma CVD method. Then, a Ta film as a cavitation resistance film is sputtered to a thickness of about 2000 Å. These SiN film and Ta film are patterned by photolithography and dry-etched to desired shapes. During this process the Ta film and SiN film on the fuse element 103 are removed.

After this, an organic resin layer is used to three-dimensionally form ink paths for ink ejection by using photolithography. The organic resin layer forms a nozzle member 107. Now the substrate 100 is completed.

FIGS. 3A, 3B, 3C and 3D show what happens when the fuse element 103 in the substrate of the above construction is blown by applying an electric current to the fuse element.

Figure 3A:
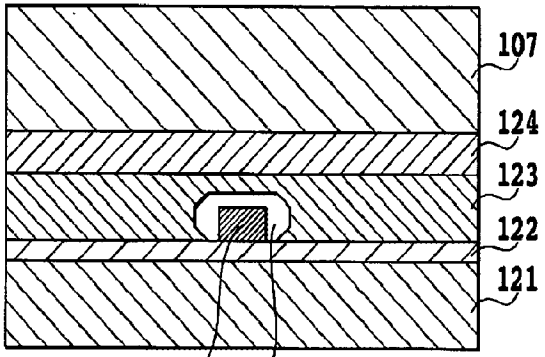
FIGS. 3A, 3B, 3C and 3D are cross-sectional views showing states of the fuse element on the substrate of FIG. 2 as it is blown.
Figure 3B:
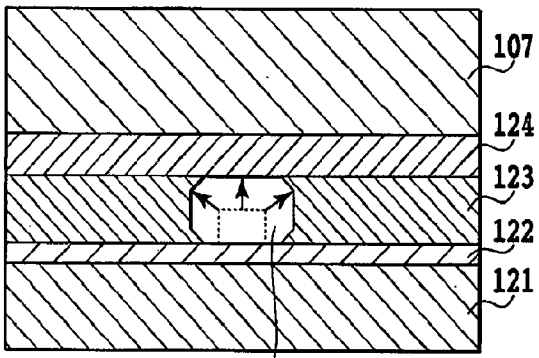
Figure 3C:
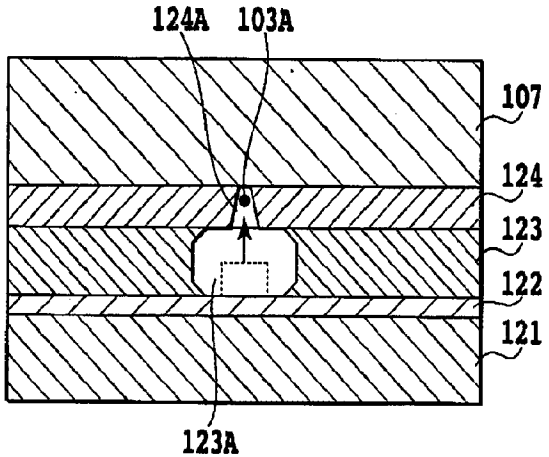
Figure 3D:
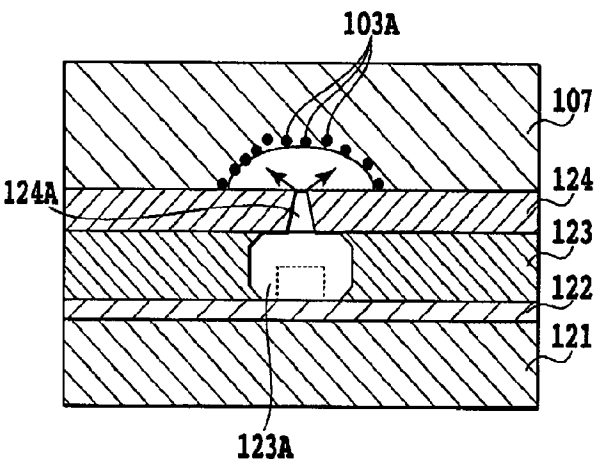

First, heat of the polysilicon fuse element 103 melts and gasifies the interlayer insulating film (SiO film) 123 containing phosphorus, namely the plasma CVD-SiO layer that has a far lower melting point than the polysilicon and is easily gasified. As a result, a cavity 123A is formed in the interlayer insulating film (SiO film) 123, as shown in FIG. 3A. The cavity 123A expands as shown in FIG. 3B and its expansion is stopped by the protective film (insulating film) 124 or plasma CVD-SiO layer not containing phosphorus. In a part of the CVD-SiO layer not containing phosphorus or protective film (insulating film) 124 a through-hole 124A is formed by heat and pressure, as shown in FIG. 3C. The melted mass 103A of the polysilicon fuse element 103 is blown into the hole 124A. The melted polysilicon 103A blown into the hole 124A melts and carbonizes a part of the organic resin nozzle member 107, as shown in FIG. 3D, losing its thermal energy and solidifying as it cools.

As described above, the interlayer insulating film (SiO film) 123 containing phosphorus forms the cavity 123A to release the inner pressure produced by the melting of the fuse element 103. The protective film (insulating film) 124 not containing phosphorus forms the hole 124A in one portion thereof to release the inner pressure and minimize the expansion of the cavity 123A. This helps prevent cracks from developing in the substrate 100. The melted mass 103A of the polysilicon fuse element 103 is arrested at positions an almost predetermined distance from the blown portion of the fuse element 103. For example, the melted mass 103A is received within about 2 μm into the organic resin nozzle member 107. This ensures the reliable blowing of the fuse element 103. Should the melted mass 103A remain on the melted portion of the fuse element 103, the reliability of the blowing operation of the fuse element 103 is impaired.

Second Embodiment

Figure 4:
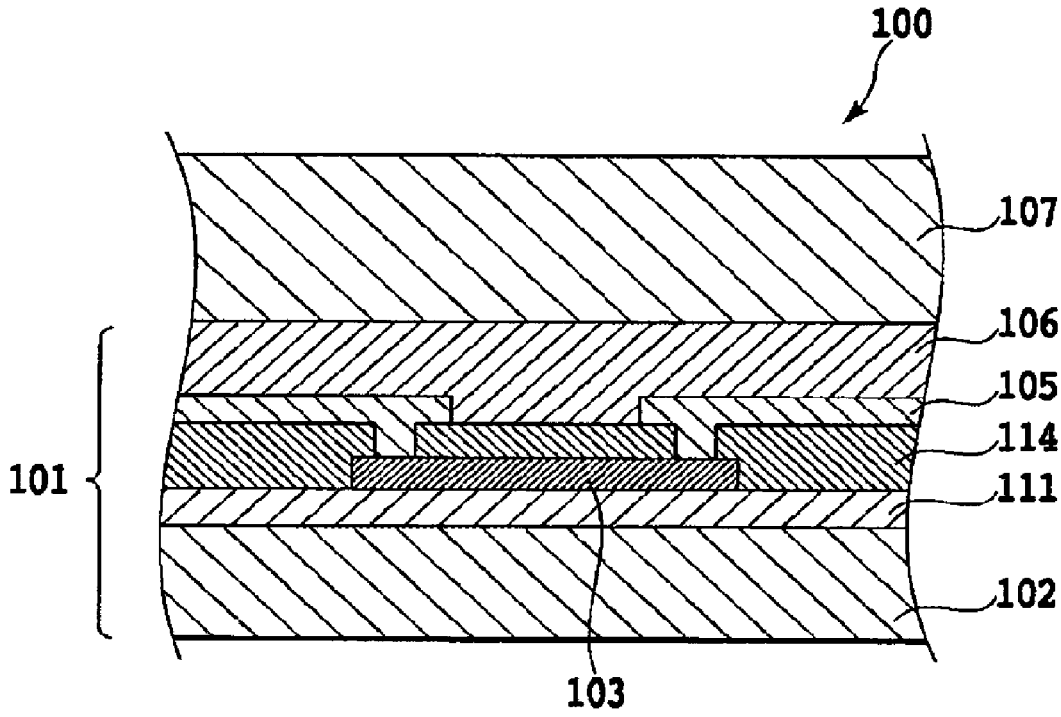
FIG. 4 is a cross-sectional view of a substrate in a second embodiment of this invention.
Figure 5:
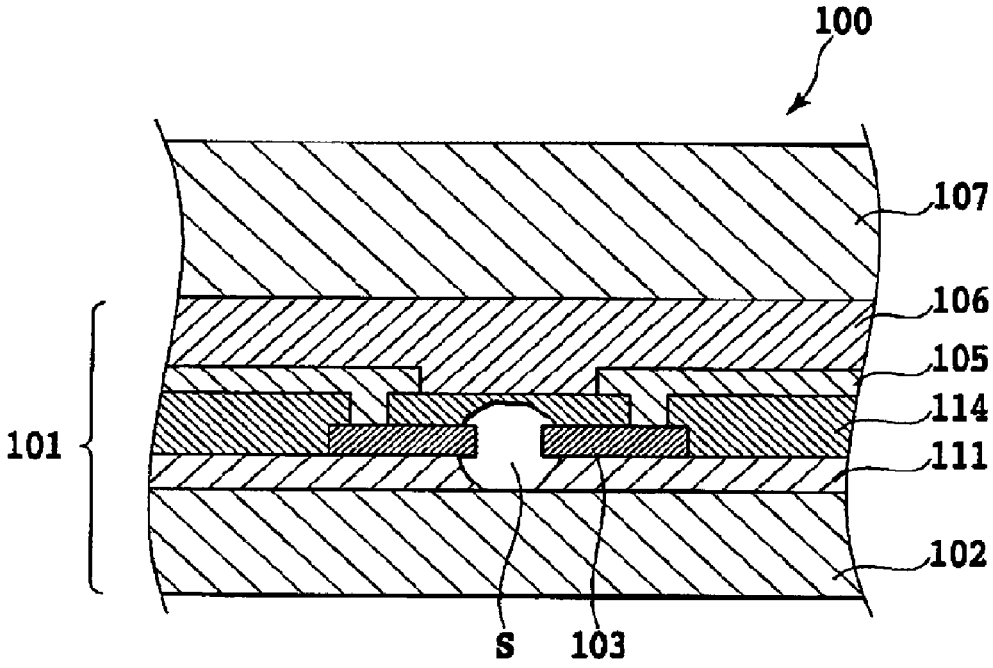
FIG. 5 is a cross-sectional view showing how the fuse element on the substrate of FIG. 4 is blown.

FIG. 4 and FIG. 5 are explanatory views showing a substrate 100 for an ink jet print head in the second embodiment of this invention.

As shown in FIG. 4, on the surface of the base substrate 102 of the print head substrate 100 an SiO film containing phosphorus is deposited by the plasma CVD method to a thickness of about 4000 Å to form an interlayer insulating film 111. Over the interlayer insulating film 111 polysilicon for the fuse element 103 is deposited to a thickness of about 4000 Å and patterned to form the fuse element 103. Further, over the fuse element 103 an SiO film containing phosphorus for the interlayer insulating film 114 is deposited to about 6000 Å by the plasma CVD method. As a result, the fuse element 103 is vertically sandwiched between the interlayer insulating films 111, 114 that are SiO films containing phosphorus.

The interlayer insulating films 111, 114 as the SiO films containing phosphorus have a lower melting point than polysilicon of the fuse element 103. Thus, when an electric current is passed through the fuse element 103 to blow it, the heat produced by the current easily gasifies the interlayer insulating films 111, 114, forming a cavity S as shown in FIG. 5. Because the interlayer insulating films 111, 114 with a lower melting point than the fuse element 103, i.e., the phosphorus-containing SiO films, are formed over and below the fuse element 103, the cavity S is formed in each of these interlayer insulating films 111, 114. By forming the cavity S not only in the upward direction but also in the downward direction, the formation of the cavity S in the upward direction can be restrained to prevent cracks from forming in a film further up.

The greater the destructive force generated by the blowing of the fuse element 103, the larger the cavity S will become. To prevent polysilicon that forms the fuse element 103 from being ruptured excessively, the thickness of the interlayer insulating films 111, 114 is preferably set in a range of 0.5-1 μm.

Over the interlayer insulating film 114 an SiO film not doped with phosphorus is deposited by the plasma CVD method to form a protective film (insulating film) 106 to control the cavity S. The protective film (insulating film) 106 is formed to a thickness of 6000 Å. This protective film (insulating film) 106 does not easily melt when subjected to heat and therefore can restrain the expansion of the cavity S in the phosphorus-containing SiO layers, or the interlayer insulating films 111, 114, thus controlling the cavity to a desired size. As with the protective film (insulating film) 124 of the preceding embodiment, the protective film (insulating film) 106 may be slow in melting and partly melted by heat to form a hole therein. In this case, the melted mass of the fuse element 103 is released through the hole. This eliminates a problem that would result if the expansion of the inner cavity S was completely suppressed, i.e., the forming of cracks due to the inner pressure.

On a part of the surface of the interlayer insulating film 114, a fuse electrode 105 made mainly of aluminum is formed. This fuse electrode 105 is connected to the fuse element 103 via the through-hole in the interlayer insulating film 114. Over this fuse electrode 105 an SiO film is formed as the protective film (insulating film) 106. Further, a nozzle member 107 is formed over the protective film (insulating film) 106.

In this embodiment as described above, since the cavity S is formed by the fusing of the fuse element 103, cracks do not develop to the surface of the protective film 106. Thus, there is no possibility of the reliability of the fuse element being impaired.

The storing of data, such as operation characteristics of the heater elements 120, in the fuse array 130 is naturally executed after the completion of the ink jet print head 400. In this example, the layers overlying and underlying the fuse element 103, i.e., the interlayer insulating films 111, 114, are formed of an SiO film containing phosphorus and having a lower melting point than the fuse element 103. Therefore, when the fuse element 103 is blown, the cavity S is formed so that it can be accommodated between the phosphorus-containing interlayer insulating films 111, 114. Thus, the blowing of the fuse element 103 has little effect on the overlying film, preventing formation of such large cracks as will reach the overlying film.

Wires of the logic circuits in the ink jet print head 400 are formed of a polysilicon layer, and the fuse elements 103 of the fuse array 130 are also formed of the same polysilicon layer. So, when forming a print control logic circuit (not shown), which is an essential part of the print head, the fuse logic circuit and the fuse array 130 can also be formed simultaneously to improve the productivity of the ink jet print head 400.

It is also possible to form the heater elements 120 of the ink ejection structure and the fuse array 130 by using the same material. This obviates the need to add new materials for the fuse array 130, improving the productivity of the substrate 100 and the ink jet print head 400.

If the storage data in the fuse array 130 are an ID code and operation characteristics, the storage capacity of the fuse array 130 is less than 100 bits. So, there is no need to use a specially prepared, large-capacity ROM chip, which in turn helps reduce the size and weight of the ink jet print head and also improves the productivity.

Third Embodiment

Figure 6:
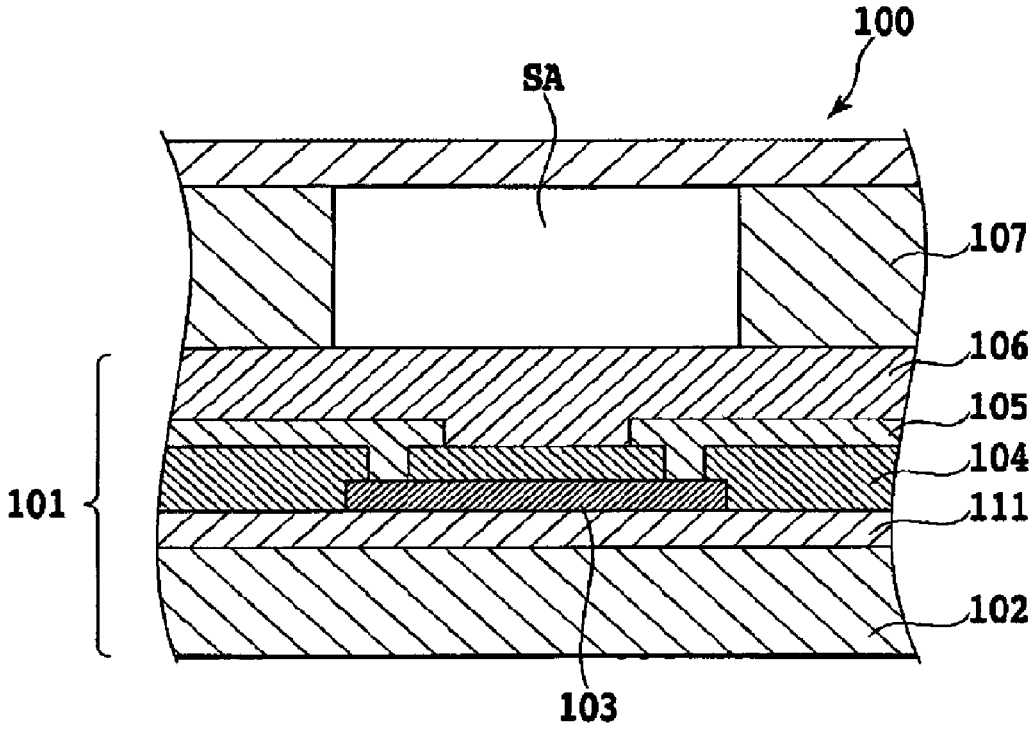
FIG. 6 is a cross-sectional view of a substrate in a third embodiment of this invention.

FIG. 6 is an explanatory view showing an ink jet print head substrate 100 in the third embodiment of this invention. This embodiment has a space SA formed above the fuse element 103 into which ink does not penetrate.

If cracks formed by the blowing of the fuse element 103 should reach the surface of the protective film 106, the intimate contact between the nozzle member 107 and the protective film 106 may deteriorate giving rise to the possibility of the ink entering into an interface between the nozzle member 107 and the protective film 106. If the ink infiltrates through the cracks and reaches the fuse element 103, the fuse element 103 may fail as by an electric short-circuit.

In this embodiment, too, since a cavity S (see FIG. 5) is formed by the blowing of the fuse element 103, as in the previous embodiment, cracks do not reach the surface of the protective film 106. Therefore, there is no problem if the space SA is formed in the nozzle member 107 as in this example.

Fourth Embodiment

Figure 7:
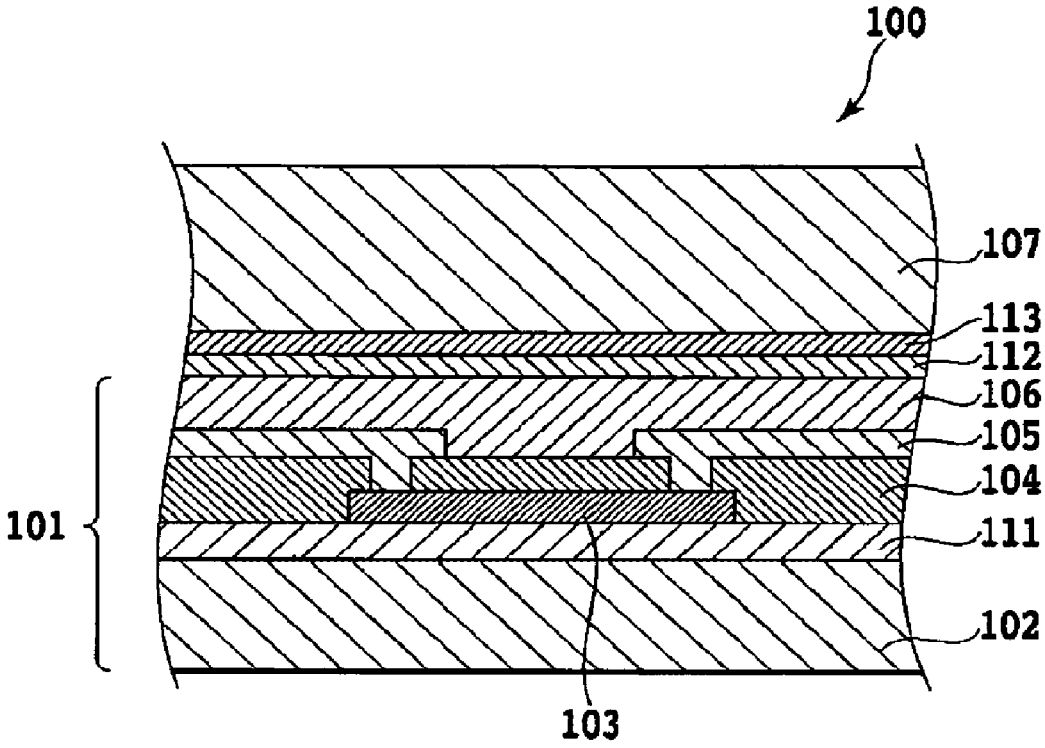
FIG. 7 is a cross-sectional view of a substrate in a fourth embodiment of this invention.

FIG. 7 is an explanatory view showing an ink jet print head substrate 100 in the fourth embodiment of this invention. This embodiment has formed over the protective film (insulating film) 106 an SiN protective film 112 and a cavitation resistance layer 113, over which a nozzle member 107 is formed.

Fifth Embodiment

FIG. 12 to FIG. 18B represent the fifth embodiment of this invention.

Figure 12:
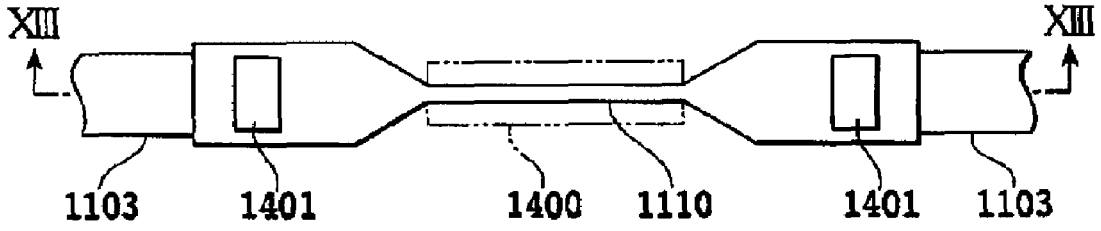
FIG. 12 is a plan view of a fuse element on a substrate in a fifth embodiment of this invention.

FIG. 12 is a plan view showing an area 1400 in which a fuse element 1110 of this example is formed.

Figure 13:
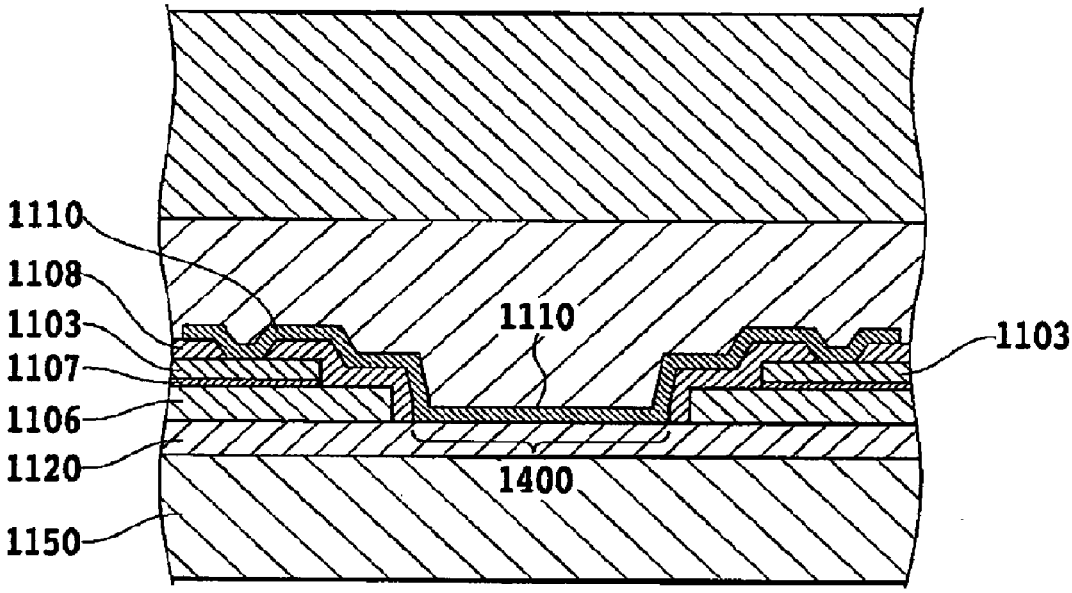
FIG. 13 is a cross-sectional view taken along the line XIII-XIII of FIG. 12.

FIG. 13 is a cross-sectional view taken along the line XIII-XIII of FIG. 12. The fuse element 1110 is built into the ink jet print head substrate simultaneously with the heater element 1102 (see FIG. 17A to FIG. 17D). FIGS. 14A, 14B, 14C and 14D show a process of forming the heater element 1102. FIGS. 15A, 15B, 15C, 15D and 15E show a process of forming the fuse element 1110. These two processes will be explained in the following in relation to each other.

Figure 14A:
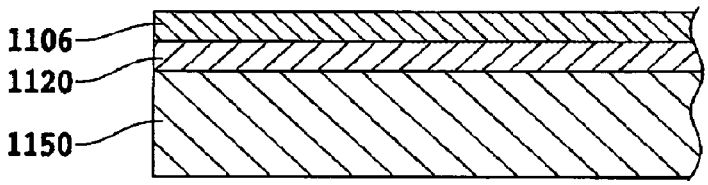
FIGS. 14A, 14B, 14C and 14D are cross-sectional views showing a process of forming the heater element on the substrate of FIG. 13.
Figure 15A:
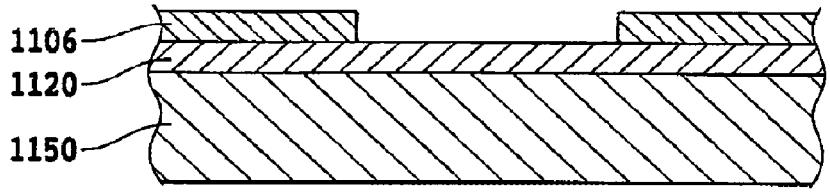
FIGS. 15A, 15B, 15C, 15D and 15E are cross-sectional views showing a process of forming a fuse element on the substrate of FIG. 13.

First, as shown in FIG. 14A and FIG. 15A, a silicon substrate 1150 is formed with a heat accumulation layer 1120 by thermal oxidation and then with a logic circuit not shown and a protective film 1120. The logic circuit has a function of selectively driving the heater elements 1102 and a function of selectively energizing the fuse elements 1110.

Next, electrode wires for connecting the logic circuit that are not shown and made of aluminum for instance are formed by sputtering and photolithography. Over the electrode wires a silicon oxide film 1106 that functions as an interlayer insulating film is deposited by the plasma CVD method to a thickness of about 1 μm. Further, contact holes are formed by photolithography to connect the logic circuit and the electrode wires. As shown in FIG. 15A, an opening is formed in fuse element forming areas 1400 in the same way as the contact holes are formed.

Figure 14B:
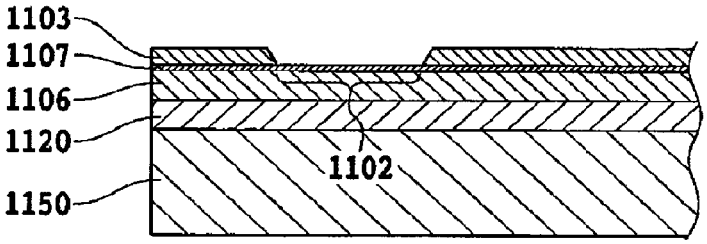
Figure 15B:
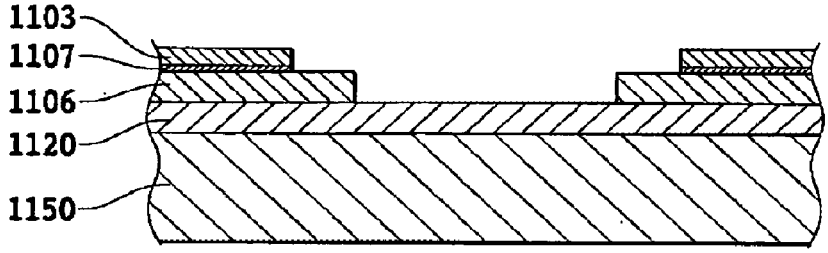

As shown in FIG. 14B, a heating resistor layer 1107 is sputtered to a thickness of about 30 nm, and then an electrode wire layer 1103 of aluminum is deposited to a thickness of about 300 nm. The electrode wire layer 1103 is then partly removed by photolithography to expose the heating resistor layer 1107, thereby forming a heater element 1102 that generates a thermal energy to eject ink. In the fuse element forming area 1400, as shown in FIG. 15B, the aluminum electrode wire layer 1103 and the heating resistor layer 1107 are removed by photolithography.

Figure 14C:
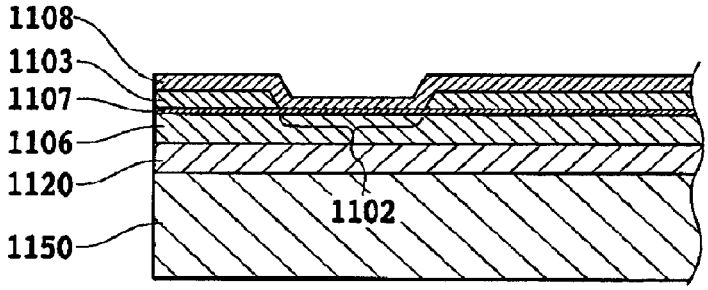
Figure 15C:
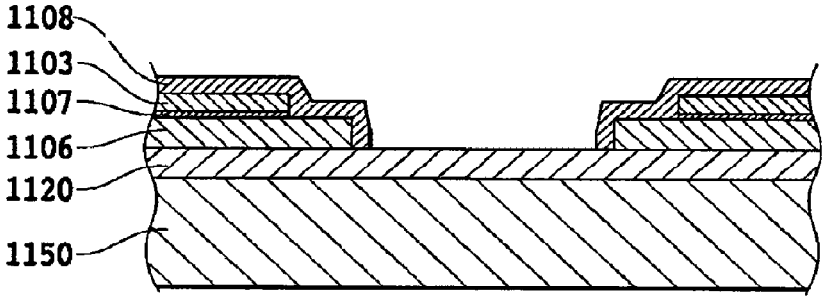

Next, as shown in FIG. 14C, over the electrode wire layer 1103 including the exposed heating resistor layer 1107 (heater element 1102), an SiN film that functions as the protective insulating film 1108 is formed to a thickness of about 300 nm by the plasma CVD method. In the fuse element forming area 1400, as shown in FIG. 15C, an SiN film that functions as the protective insulating film 1108 is formed also over the electrode wire layer 1103.

Figure 15D:
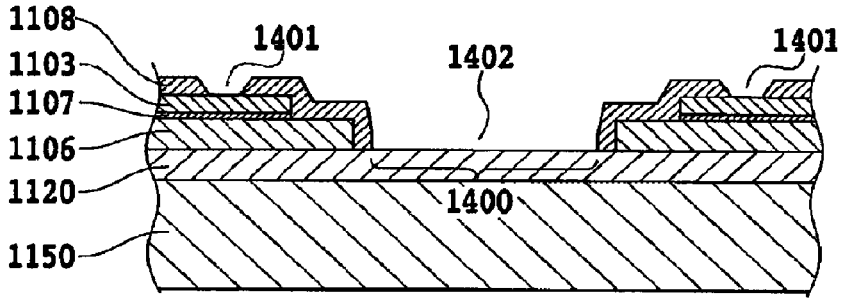

Next, contact holes for connecting the electrode wires 1103 to power supply lines and signal lines not shown are formed by photolithography. In the area 1400 to form the fuse element 1110, as shown in FIG. 15D, contact holes 1401 for power supply and a fuse forming window 1402 are formed simultaneously.

Figure 14D:
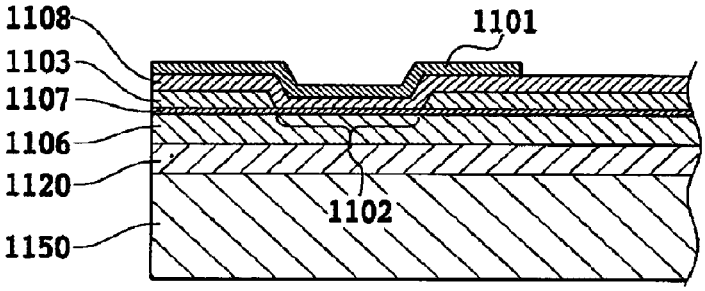
Figure 15E:
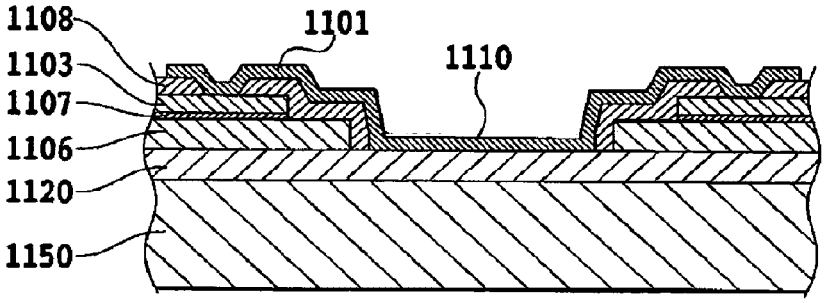

Next, as shown in FIG. 14D and FIG. 15E, a Ta layer 1101 is sputtered to a thickness of about 200 nm. The Ta layer 1101 in the area of the heater element 1102 of FIG. 14D functions as a cavitation resistance layer. In the fuse element forming area 1400 of FIG. 15E, the Ta layer 1101 is formed into a desired shape by photolithography to function as the fuse element 1110.

Figure 16:
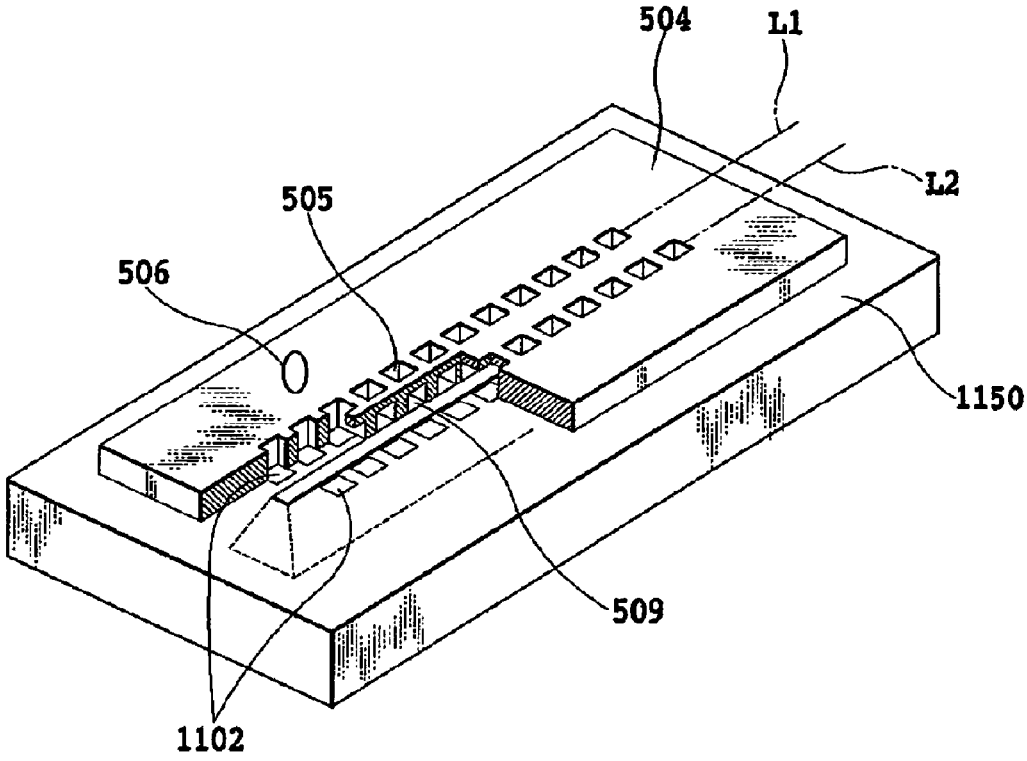
FIG. 16 is a perspective view showing a head chip, partly cut away, that is constructed by using the substrate of FIG. 12.

Using a silicon substrate 1150 formed with the fuse elements 1110 and the heater elements 1102 as described above, an ink jet print head such as shown in FIG. 16 can be constructed. In the print head of this example, the heater elements 1102 as an ink ejection energy generation means are formed in two rows (L1, L2) and arrayed at a predetermined pitch. Between the two rows of the heater elements 1102 the substrate 1150 is formed with an ink supply port 509 by silicon anisotropic etching. Over the substrate 1150 there is provided an orifice plate 504 which is formed with ink ejection openings 505 situated above the associated heater elements 1102 and with ink paths that connect the ink ejection openings 505 and the ink supply port 509. The ink ejection openings 505 and the heater elements 1102 on the row L1 and the ink ejection openings 505 and the heater elements 1102 on the row L2 are staggered by half the nozzle pitch (a pitch at which the ink ejection openings 505 and the heater elements 1102 are arrayed).

In this example, the substrate 1150 used has an Si crystal orientation of <100> on the surface where the heater elements 1102 are formed. FIG. 17A to FIG. 17D show a process of forming the ink ejection openings 505 and the ink supply port 509 when the above substrate 1150 is used. The area where the fuse elements 1110 are formed will be explained by referring to FIG. 18A and FIG. 18B.

Figure 17A:
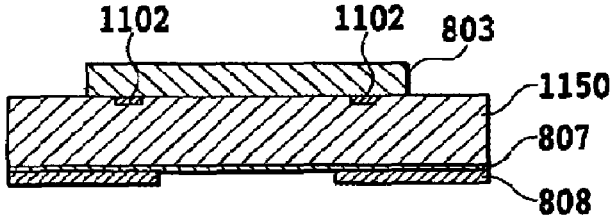
FIGS. 17A, 17B, 17C and 17D are cross-sectional views showing a process of manufacturing the head chip of FIG. 16.

In FIG. 17A, designated 807 is an $SiO_2$ film formed on the back of the substrate 1150. Over the $SiO_2$ film 807 an $SiO_2$ film patterning mask 808 with alkali resistance is formed. The mask 808 is used to form the ink supply port 509.

Next, over the surface of the substrate 1150 polyetheramide resin not shown to improve intimate contact performance is formed. For example, HIMAL may be spin-coated, patterned by photolithography and dry-etched to form a desired shape of the resin layer.

Figure 18A:
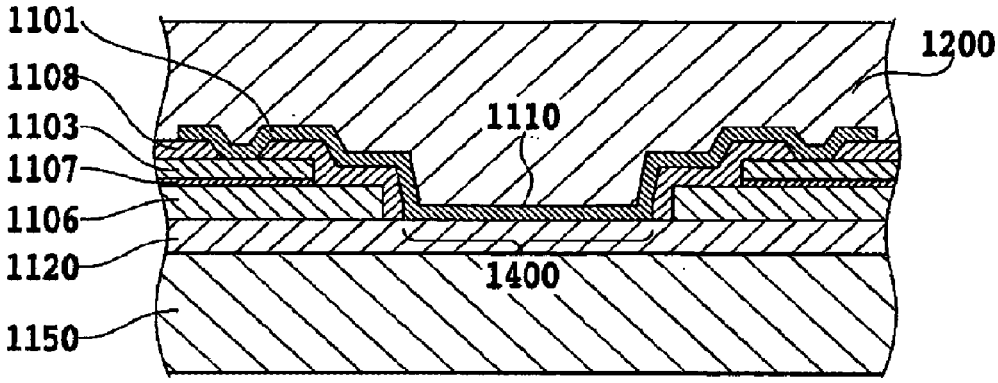
FIG. 18A and FIG. 18B are cross-sectional views of the fuse element in the process of manufacturing the head chip of FIG. 16.

In the fuse forming area 1400, an intimate contact improvement layer 1200 is filled into the fuse forming area 1400, as shown in FIG. 18A. This layer can prevent ingress of ink from outside and form an area for receiving a melted mass when the fuse element 1110 is blown.

Next, a block 803 is formed as shown in FIG. 17A. The block 803 in the following process is dissolved away to form an ink path. It is formed into a planar pattern having a height corresponding to that of the ink path.

Figure 17B:
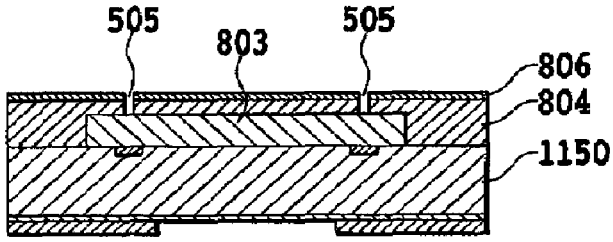

Next, as shown in FIG. 17B, an orifice plate material 804 is spin-coated over the substrate 1150 to cover the block 803 and then patterned to a desired shape by photolithography. Then, at positions above the heater elements 1102 the ink ejection openings 505 are formed by photolithography. On the surface of the orifice plate material 804 where the ink ejection openings 505 open, a water repellent layer 806 is formed by laminating dry films.

Figure 18B:
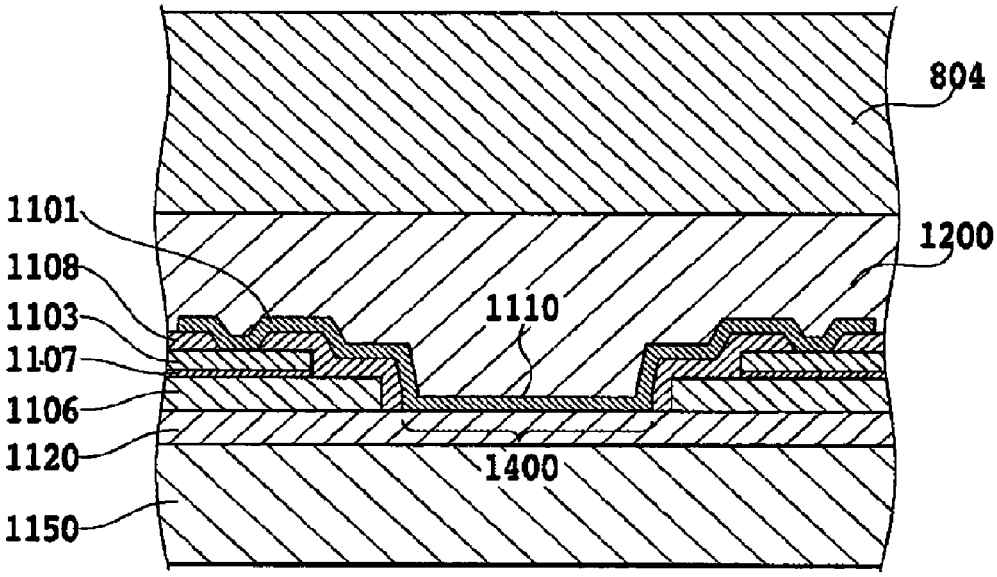

In the fuse element forming area 1400, since the orifice plate material 804 is formed over the intimate contact improvement layer 1200 as shown in FIG. 18B, ink can further be prevented from infiltrating from outside.

Figure 17C:
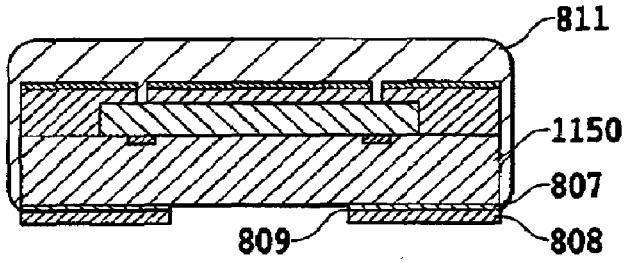

Next, as shown in FIG. 17C, a protective material 811 of resin is spin-coated over the surface of the substrate 1150 formed with the functional elements of the print head and over the side surfaces. This is intended to prevent an etch liquid from coming into contact with the surface of the substrate 1150 formed with the print head functional elements and with the side surfaces when the ink supply port 509 is formed in a later process. The protective material 811 used has a sufficient resistance to a strong alkaline solution that is used for anisotropic etch. By covering the orifice plate material 804 also with the protective material 811, degradation of the water repellent layer 806 can be prevented.

Next, with the $SiO_2$ film patterning mask 808 that was formed beforehand used as a mask, an $SiO_2$ film 807 is patterned as by wet-etching to expose an opening 809 for etch start on the back of the substrate 1150.

Figure 17D:
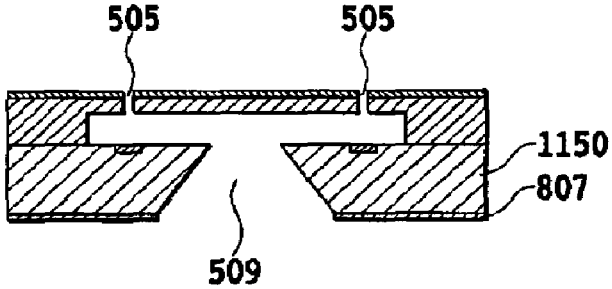

Next, as shown in FIG. 17D, an anisotropic etching is performed using the $SiO_2$ film 807 as a mask to form the ink supply port 509. An etch liquid for this anisotropic etching may be, for example, a strong alkaline solution such as TMAH (tetramethyl ammonium hydroxide) solution. In that case, a 22 wt % solution of TMAH is set at 80° C. and then applied from the etch start opening 809 to the substrate 1150 for a predetermined time (a dozen hours) to form the ink supply port 509.

Next, the $SiO_2$ film patterning mask 808 and the protective material 811 are removed. Further, the block 803 is dissolved away through the ink ejection openings 505 and the ink supply port 509 and then dried. The dissolution of the block 803 can be achieved by performing a flood exposure with deep ultraviolet light and a subsequent development. During the development process an ultrasonic dipping may be performed as required to remove the block 803 virtually completely.

With the above steps taken, the process of manufacturing the head chip, an essential part of the ink jet print head, is complete. The head chip formed in this way is provided with electrical connections to the heater elements 1102 and fuse elements 1110 and mounted with tanks for ink supply, as required. As for the layers overlying and underlying the fuse elements 1110, they may be formed of the similar material and in the similar shape to those of the first embodiment.

By using the print head substrate of this embodiment, the ink jet print head can reliably blow the fuse array to render selected fuses electrically open, storing data reliably. Since the cavitation resistance film and the fuse elements 1110 are formed of the same material, there is no need to add a new material for the fuse elements 1110, improving the productivity of the print head substrate.

Figure 19:
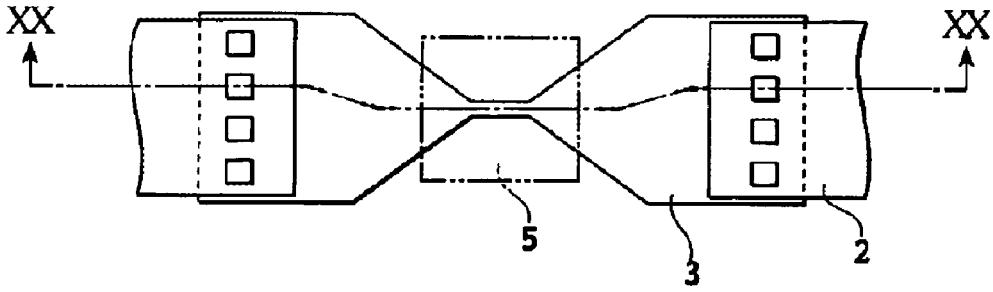
FIG. 19 is a plan view of a fuse element on the substrate as an example for comparison with this invention.
Figure 20:
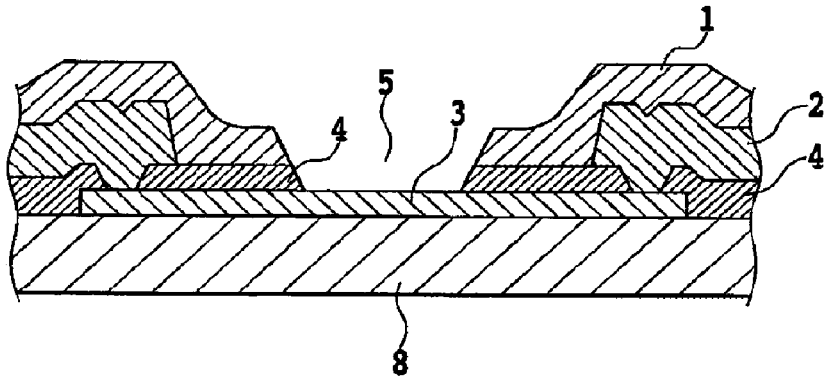
FIG. 20 is a cross-sectional view taken along the line XX-XX of FIG. 19.

FIG. 19 and FIG. 20 show an example construction to be compared with the print head substrate of this embodiment. In the print head substrate for comparison, fuse elements 3 are constructed of gate wires of MOS's (Metal-Oxide Semiconductors) that form a logic circuit on the substrate 8. Over the fuse elements 3 are formed a plurality of interlayer insulating films 4 and inorganic films functioning as the protective films 1. Further, above the blow portions of the fuse elements are formed openings 5. If the blow portions of the fuse elements 3 should be covered with the interlayer insulating films 4 and protective films 1 having a relatively high mechanical strength, without forming the openings 5, a melted mass produced when the fuse element is blown may fail to be scattered far enough and, after the fusing, reconnections may occur. To form the opening 5, however, requires the fuse element 3 to function as an etch stop layer. This may damage the fuse element 3 during an etch operation in the form of, for example, a reduced thickness of the fuse element, which in turn may change the resistance of the fuse element and therefore the current required to blow it, making the blowing of the fuse element unreliable.

In contrast to the comparison example, this embodiment forms the fuse element using the same material as the cavitation resistance film, making it unnecessary to remove the inorganic film by etching. This eliminates the possibility of damages to the fuse element and, by applying an organic material over the fuse element, ingress of ink from outside can be prevented. The organic material may be one that softens at low temperatures, allowing a cavity to be formed large in the organic material by the heat generated by the blowing of the fuse element. The cavity, large enough to accommodate the melted mass from the blown fuse element, assures the reliable blowing of the fuse element.

Other Embodiment

This invention is not limited to the embodiments described above and various modifications may be made without departing from the spirit of the invention. For example, the ink ejection system may employ an electromechanical conversion system using piezoelectric elements instead of the above-described electrothermal conversion system that uses the heater elements 120.

Further, the present invention can not only be applied to the serial scan type ink jet printing apparatus described above but also to a so-called full-line type ink jet printing apparatus. In the full-line type ink jet printing apparatus an elongate ink jet print head extending in a widthwise direction of a print medium is used.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2005-132315 filed Apr. 28, 2005 and 2006-075236 filed Mar. 17, 2006, which are hereby incorporated by reference herein.

What is claimed is:

1. An ink jet print head substrate comprising:

a fuse element capable of being blown by passing an electric current therethrough;

a layer formed in contact with the fuse element; and an other layer formed in contact with a side of the fuse element opposite to the layer, the other layer having a melting point higher than that of the layer and lower than that of the fuse element, wherein the layer has a melting point lower than that of the fuse element, a part of the layer being gasified to form a cavity in the layer when the fuse element is blown; and wherein the other layer is gasified to form a cavity in the other layer when the fuse element is blown.

2. The ink jet print head substrate according to claim 1, wherein the layer consists primarily of an oxide of silicon containing phosphorus.

3. The ink jet print head substrate according to claim 1, wherein the layer is formed by a plasma CVD method.

4. The ink jet print head substrate according to claim 1, wherein a plurality of the fuse elements are formed to construct a fuse array.

5. The ink jet print head substrate according to claim 4, wherein data can be stored by selectively blowing the plurality of fuse elements.

6. The ink jet print head substrate according to claim 1, wherein the layer formed on the fuse element, and wherein a member consists of a resin is formed above the layer.

7. The ink jet print head substrate according to claim 1, wherein the other layer consists primarily of an oxide of silicon not containing phosphorus.

8. The ink jet print head substrate according to claim 1, wherein the fuse element consists primarily of a polysilicon.

9. An ink jet printing apparatus for printing an image on a print medium by using an ink jet print head including the ink jet print head substrate claimed in claim 5, the apparatus comprising a reading unit that reads data stored in the fuse element of the ink jet print head substrate.

10. An ink jet print head substrate comprising:

a heating portion to generate an energy for ejecting ink;

a protective layer for protecting the heating portion;

a fuse element capable of being blown by passing an electric current therethrough;

a layer formed in contact with the fuse element; and an other layer formed in contact with a side of the fuse element opposite to the layer, the other layer having a melting point higher than that of the layer and lower than that of the fuse element, wherein the layer has a melting point lower than that of the fuse element, a part of the layer being gasified to form a cavity in the layer when the fuse element is blown, wherein the layer and the protective layer are formed of the same material; and wherein the other layer is gasified to form a cavity in the other layer when the fuse element is blown.

11. The ink jet print head substrate according to claim 10, wherein the material consists primarily of a tantalum.

* * * * *